US010198911B2

(12) United States Patent
Kohl et al.

(10) Patent No.: US 10,198,911 B2
(45) Date of Patent: Feb. 5, 2019

(54) ROULETTE GAMING METHOD, SYSTEM AND APPARATUS

(71) Applicant: Crown Melbourne Limited, Southbank, VIC (AU)

(72) Inventors: Linh Kohl, Southbank (AU); Daryl Bruce, Southbank (AU); David Croft, Southbank (AU)

(73) Assignee: CLUB GAMING PTY LTD, Southbank (AU)

( * ) Notice: Subject to any disclaimer, the term of this patent is extended or adjusted under 35 U.S.C. 154(b) by 0 days.

(21) Appl. No.: 15/148,010

(22) Filed: May 6, 2016

(65) Prior Publication Data

US 2016/0328905 A1 Nov. 10, 2016

(51) Int. Cl.

| | |
|---|---|
| ***G07F 17/00*** | (2006.01) |
| ***G07F 17/32*** | (2006.01) |
| ***A63F 5/00*** | (2006.01) |

(52) U.S. Cl.

CPC ..... *G07F 17/329* (2013.01); *A63F 5/00* (2013.01); *G07F 17/32* (2013.01); *G07F 17/3227* (2013.01); *G07F 17/3244* (2013.01); *G07F 17/3262* (2013.01)

(58) Field of Classification Search

CPC ..... G07F 17/32

See application file for complete search history.

(56) References Cited

U.S. PATENT DOCUMENTS 5,184,821 A * 2/1993 Korenek ..... A63F 5/04 273/138.2

8,622,808 B2 * 1/2014 Pececnik ..... G07F 17/3202 463/16

2004/0087357 A1 * 5/2004 Johnson ..... G07F 17/32 463/17

* cited by examiner

*Primary Examiner* — Reginald Renwick

(74) *Attorney, Agent, or Firm* — Eversheds Sutherland (US) LLP

(57) ABSTRACT

The present invention provides a roulette game, including:

a roulette wheel having a series of numbers, each number additionally having an assigned color characteristic;

a betting layout having marked areas whereby one or more players may place a bet on a result of the roulette wheel, the betting layout further including first and second side bet areas for placing first and second side bets;

spinning the roulette wheel to produce a game result comprising one of the roulette wheel numbers and its assigned color characteristic;

a random number generator producing, for each spin of the roulette wheel, first and second random numbers selected from the same series of numbers with assigned color characteristics as represented on the roulette wheel;

a display of first and second random numbers;

settling roulette bets on the basis of the roulette wheel game result;

settling the first side bets on the basis of the roulette wheel game result numerically matching one or both of the first and second random numbers; and settling the second side bets on the basis of the roulette wheel game result color characteristic matching both of the first and second random number color characteristics.

8 Claims, 6 Drawing Sheets

ROULETTE GAMING METHOD, SYSTEM AND APPARATUS

RELATED APPLICATIONS

This application claims priority to Australian Provisional Patent Application No. 2015901653 in the name of Crown Melbourne Limited, which was filed on 7 May 2015, entitled "Roulette Gaming Method, System and Apparatus" and the specification thereof is incorporated herein by reference in its entirety and for all purposes.

FIELD OF INVENTION

The present invention relates to the games upon which wagers may be placed, particularly involving a roulette wheel.

It will be convenient to hereinafter describe the invention in the context of casino gaming, however it should be appreciated that the present invention is not limited to that application only.

BACKGROUND ART

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

The game of roulette is a well-established game of chance played in casinos worldwide. The roulette wheel itself comprises a horizontal wheel having numbered pockets around its periphery mounted at the bottom of a bowl-shaped housing and adapted to rotate about a vertical axis. The number of each pocket is typically displayed adjacent to the pocket, and each number has an associated colour (e.g., red, black or green) typically indicated by the colour of the background on which the number is marked. A conventional American roulette wheel has thirty-eight numbered pockets displaying the numbers 1 through 36 (each assigned a colour of red or black), and the house numbers 0 and 00 (typically assigned the colour green). In playing the game players bet on the outcome of a number selection made by operation of the roulette wheel as described below. The bets are made on a gaming layout located on the gaming table adjacent to the wheel, which displays the numbers of the pockets on the roulette wheel as well as certain characteristics such as: parity (odd or even), colour (red or black), number range ($1^{st}$ 12, $2^{nd}$ 12, $3^{rd}$ 12). Players signify their bets on the possible numbers or characteristics selected by the operation of the roulette wheel by placing chips or markers at predetermined locations on the betting layout. Once the bets have been placed the operator or croupier introduces a small ball into the bowl surrounding the spinning wheel and projects the ball tangentially within the bowl, generally in a direction opposite to the rotation of the wheel. The ball may roll around the interior of the bowl several times before it loses speed and falls toward the centre of the bowl, where it encounters the spinning roulette wheel. Eventually the ball becomes trapped in one of the numbered pockets of the wheel, thereby defining the outcome of the play. Bets are paid on the winning outcome i.e., numbers, combinations of numbers or characteristics of the numbers, according to the conventional odds associated with the game of roulette.

Typically, the roulette betting layout contains the numbers 1-36 as well as 0 and 00 each displayed in an individual cell on a background of its designated colour. In the layout more common in Europe only the number 0 is used in addition to the numbers 1-36 and the roulette wheel has only thirty-seven pockets. Bets may be made on individual numbers, by placing markers thereon, or on combinations of adjacent numbers, by placing markers on dividing lines between the numbered cells. Certain locations on the betting layout are defined for bets on certain combinations of numbers, or on red or black, or on odd or even. The payoff odds for a bet on a winning outcome are determined generally by the probability of the occurrence of a particular outcome. For example, a bet on an individual number pays 35 to 1, a bet on the combination of numbers 1-18 pays 2 to 1, and a bet on odd or even or red or black pays even money.

One known variation on roulette is found in WO 2004/024266 (Paltronics, Inc.). The 'multi-game system' of WO 2004/024266 is directed to the problems associated with a single roulette game not being able to accommodate all players that may wish to participate, particularly where the players are of differing proficiency and experience. These problems are addressed by providing a gaming device for allowing a player to play multiple games simultaneously. The gaming device comprises at least one game source, a server in communication with the game source, at least one display device in communication with the server, and at least one input device in communication with the display device. The game source provides at least one game to the player. The server is configured to combine data to create a set of games for display on the display device. The player is allowed to specify games to play and place a wager using the input device. After games are completed, game outcomes are displayed on the display device. In effect, the multi-game system of WO 2004/02466 allows players to electronically place wagers on one or more Roulette games. Each roulette game is independent of each other and therefore does not produce any side betting option in addition to the traditional game.

AU-B 725571 (London Casino Supplies (Australia) Pty Ltd) provides a method of wagering on multiple independent games played substantially together or simultaneously to provide additional winning opportunities for players thereby to enhance the playing experience. In AU725571 there are two results generated, namely, the Primary Game (PG) and the Secondary (SG) Game. In this disclosure a player can have a wager on the PG and/or the SG and will win the PG if they have a winning wager on the PG and win on the SG if they have a winning wager on the SG and/or the PG.

The preamble of AU-B 725571 discusses another prior art variation of Roulette, namely, U.S. Pat. No. 5,540,442 (Orselli et al), which discloses a variation to a roulette game which provides "an additional betting opportunity" but does not provide an independent second or secondary game as such. With Orselli et al a system of "side bets" is disclosed which relies on an identical match between the result given by the roulette wheel and a separate random number generator. If the results are identical then a jackpot payout is provided. If they are not the same then no jackpot pay out of any kind is provided. Whilst the primary game (Roulette)

portion of the layout remains unchanged, the layout portion of the secondary game displays individually the corresponding numbers of the wheel as individual betting areas. As a result there is 37 or 38 different betting areas required in addition to the traditional Roulette betting layout for the side bet. A player must make a wager on the primary Roulette game to make a wager on the side game. In the system described in Orselli et al, a player must select the exact winning result of the traditional wheel and also the exact result produced by the Random Number Generator used for the side bet. By way of explanation, if the player thinks both results will be 33, they must make a wager on the primary game then make a wager on 33 on the side bet. To win, both results must be 33. This places a great onus on the player to determine the outcome of a random number generator in addition to their bet on the traditional Roulette game. By use of only a single random number generator, Orselli et al provides a wager payment that is a single specified odd. For example, a result of a '33' on the traditional Roulette wheel and a '33' on the random number generator will pay at odds of 1000 to 1. There is no variation to payout.

International patent publication No. WO 02/056984 (Coinmaster Gaming Limited) discloses an automatic gaming apparatus that utilises two mechanical wheels to produce two independent results. A player may place a wager on one or two wheels. If the same result appears on both wheels, the player wins even larger odds than traditional roulette. This device also holds some of the funds to create a jackpot.

US patent publication No. US 2010/0102507 discloses a gaming table, method and device which has a number of mechanical concentric independent additional rings within a roulette wheel, thus producing more results, again from additional independent games being provided. Players may place a wager on how many of the independent rings will match e.g. match×3.

WO 00/33269 (Coinmaster Gaming Limited) discloses an electronic gaming or amusement machine directed to Roulette which gives the player or players the opportunity to play according to substantially increased betting odds by either playing more than one random selecting means, (ie a wheel) or playing a single random selecting means twice in succession. This system is also reliant on independent games being operated.

While roulette is a very popular game, it has suffered in comparison with some other modern games of chance because it does not provide the possibility of a very large payout for any of the defined bets. Traditionally, the greatest return on a bet is 35 to 1, which is the payoff for a successful bet on a single number. There has been no possibility of a large win such as is possible in certain slot machine gaming devices, for example.

In view of the foregoing, it is desired to address or ameliorate one or more disadvantages or limitations associated with the prior art, or to at least provide a useful alternative. It would be desirable, for example, to provide a game that maintains the essential characteristics of traditional roulette whilst enhancing interest in the game by enabling the possibility of a large payout for a single bet.

SUMMARY OF INVENTION

In accordance with the present invention there is provided a method of operating a casino roulette game, including:

providing a roulette wheel having a series of numbers, each number additionally having an assigned colour characteristic;

providing a betting layout having marked areas whereby one or more players may place a bet on a result of the roulette wheel, the betting layout further including at least one side bet area for placing at least one side bet;

spinning the roulette wheel to produce a game result comprising one of the roulette wheel numbers and its assigned colour characteristic;

providing a random number generator producing, for each spin of the roulette wheel, at least one random number selected from the same series of numbers with assigned colour characteristics as represented on the roulette wheel; and displaying said at least one random number; and settling roulette bets on the basis of the roulette wheel game result;

settling the at least one side bet on the basis of the roulette wheel game result matching the at least one random number with one or a combination of colour characteristic and number.

In accordance with the present invention there is also provided a method of operating a casino roulette game, including:

providing a roulette wheel having a series of numbers, each number additionally having an assigned colour characteristic;

providing a betting layout having marked areas whereby one or more players may place a bet on a result of the roulette wheel, the betting layout further including first and second side bet areas for placing first and second side bets;

spinning the roulette wheel to produce a game result comprising one of the roulette wheel numbers and its assigned colour characteristic;

providing a random number generator producing, for each spin of the roulette wheel, first and second random numbers selected from the same series of numbers with assigned colour characteristics as represented on the roulette wheel; and displaying said first and second random numbers; and settling roulette bets on the basis of the roulette wheel game result;

settling the first side bets on the basis of the roulette wheel game result numerically matching one or both of the first and second random numbers; and settling the second side bets on the basis of the roulette wheel game result colour characteristic matching both of the first and second random number colour characteristics.

In accordance with the present invention there is also provided a roulette game apparatus, comprising:

a roulette wheel having a series of numbers, each number additionally having an assigned colour characteristic;

a betting layout having marked areas whereby one or more players may place a bet on a result of the roulette wheel, the betting layout further including at least one side bet area for placing at least one side bet;

the roulette wheel adapted for spinning to produce a game result comprising one of the roulette wheel numbers and its assigned colour characteristic;

a random number generator producing, for each spin of the roulette wheel, at least one random number selected from the same series of numbers with assigned colour characteristics as represented on the roulette wheel;

display means for displaying said at least one random number; and processing means for settling roulette bets on the basis of the roulette wheel game result; and settling the at least one side bet on the basis of the roulette wheel game result matching the at least one random number with one or a combination of colour characteristic and number.

In accordance with the present invention there is also provided a roulette game system comprising the roulette game apparatus as disclosed wherein the random number generator comprises one or more additional roulette wheels.

In accordance with the present invention there is further provided apparatus adapted to provide a casino roulette game, said apparatus including:

processor means adapted to operate in accordance with a predetermined instruction set, said apparatus, in conjunction with said instruction set, being adapted to perform the method as set forth hereinabove.

The game of the present invention may typically be played in a casino situation with a croupier and one or more players. However, the game can also be played using automated mechanical or electronic methods of operating the, or each, roulette wheel and also for the payment and collection of wagers. The game can also be adapted to be played on a video screen with a single player. Equally, the present invention may be embodied using telecommunications and computer data networks.

Advantageously embodiments of the present invention allow players to, continue to play on a traditional live table and add an additional side wager where the side wager is based on the characteristics of the live wheel.

Embodiments of the present invention provide a betting layout for accommodating side wagers with a minimal impact upon a traditional betting layout, which simplifies participation in the side wager and will not be a detriment to players as they participate in a traditional Roulette game along with experiencing the opportunity for the increased payout offered by the side wager. For example, only one betting area is required for placing a side bet on a number match which suffices for all the 37 or 38 numbers of Roulette.

A player wagering on a Roulette game in accordance with an embodiment of the present invention will win the primary game of Roulette if they have a winning wager on the primary game and will win the side wager result if the characteristics of the side wager result and the characteristics of the primary game result produce a winning combination. In other words, a player may make a wager on the primary Roulette game and/or the side bet. As such the player is not restricted in their wagering options, thus giving more flexibility and freedom of choice on how they wish to wager.

Advantageously, according to embodiments when participating in the 'number match' portion of the side bet, a player does not have to make a specific number selection for the side bet. Rather, a player makes a wager on the single "Number Match" area, and if the traditional wheel and the random number generator of a Roulette number display the same number, the player will win. This allows any match of numbers to be a winning result for the player, rather than a player prescribing a specific number in their side bet.

The use of more than one random number generator (RNG) or at least the generation of more than one randomly generated number in the side bet allows for a greater variety of experience for players. Moreover, the use of more than one random number generator provides for the winning wager to be tiered. By way of example, a '33' result on a traditional Roulette wheel and a '33' on one RNG pays 12 to 1, whereas a '33' result on the traditional wheel and a '33' on two RNGs pays 300 to 1.

Advantageously the present invention can provide an increased pay out for players compared to traditional Roulette but can maintain the traditional game feel by way of using an electronically generated wheel to match multiple characteristics of a traditional roulette wheel.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present invention may be better understood by those skilled in the relevant art by reference to the following description of embodiments taken in conjunction with the accompanying drawings, which are given by way of illustration only, and thus are not limitative of the disclosure herein, and in which.

DETAILED DESCRIPTION

Figure 1:
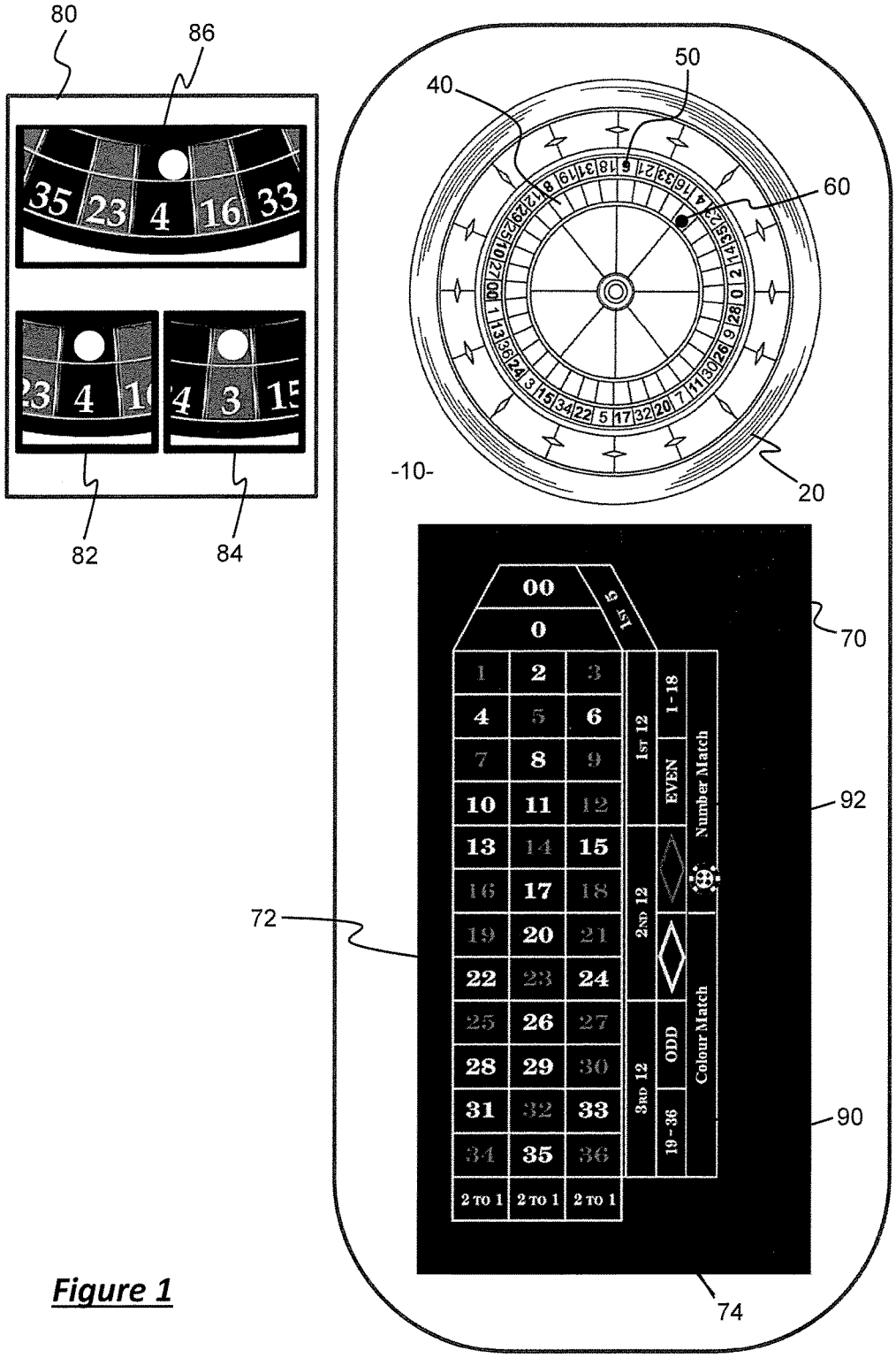
FIG. 1 diagrammatically illustrates a roulette table and display arranged for implementation of an embodiment of the present invention.

Games, gaming systems and methods are described hereinbelow in accordance with embodiments of the present invention. The preferred embodiment involves a game based on roulette with the introduction of additional side wagers which provide players with the opportunity for a relatively large pay-out compared with those available in ordinary roulette.

Roulette is a well-known casino game which has been played for many years. A roulette table 10 is shown in diagrammatic plan view in FIG. 1, including generally a roulette wheel 20 and a wagering surface 70. The typical roulette wheel includes a number ring bearing a circular array of numbered segments (50) bearing numbers 1 through 36. In addition, the number ring typically includes the numbers 0 and 00 disposed at diametrically opposite locations on the number ring, or a "0" on its own. The numbers 1 through 36 are not disposed in numerical order, but are typically disposed in a predetermined arrangement. The numbers disposed in a circular array in the number ring region of the wheel bear the alternating colours of red and black, with the exception of the 0 and 00 numbers, which are typically coloured green. A ring of pockets (40) corresponding in number to the plurality of numbers of the circular number ring lies adjacent, but radially inward of the number ring, on the typical roulette wheel. In addition, a typical roulette wheel includes a circular, inclined ball track, disposed above, and radially outwardly of the number ring.

In operation of a typical roulette game, players place chips or tokens on a betting layout located on the wagering surface (70) of the roulette table 10. To begin the game the croupier or dealer spins the roulette wheel and places the ball in motion about the circular ball track. As the wheel and the motion of the ball slow, the ball rolls radially inwardly and eventually comes to rest in one of the pockets associated with a particular number of the number ring (e.g. as shown at 60 in FIG. 1). After the ball comes to rest in one of the pockets, the croupier or dealer settles the various wagers placed on the table layout in accordance with predetermined rules and wager odds and the process is repeated.

The typical wagering surface 70 includes a plurality of marked indicia representing the various bets that players can place on the outcome of the game. Each of the numbers on the wheel (1-36, 0 and 00) are represented in the region shown at 72, allowing players to place a bet that the ball will come to rest in the corresponding numbered pocket on the wheel. The payout for a winning bet on a particular number is typically 35-to-1. Other regions (74) provide a simplified way for players to wager on a range of numbers at once, with payout odds correspondingly reduced. For example, players may place a single bet representing a wager on all of the odd numbers, all of the even numbers, all of the red numbers, all of the black numbers, or various other subsets of the wheel numbers categorised in other ways.

A computer-controlled display (shown diagrammatically at 80 in FIG. 1) may be provided to display information about the game including, for example, the most recent winning number (86) and previous winning numbers. Information about the winning number results from the physical roulette wheel may be input to the computer controlling the display screen by the croupier, or may be provided automatically using various types of sensor (as discussed further below).

In ordinary roulette the maximum payout odds for any single wager is generally 35-to-1 on a matching winning single-number bet. Embodiments of the present invention provide two additional side-wagers that allow the opportunity for much larger payouts, based on the result of the physical roulette wheel and two additional random number generators. In particular, two random number generators are used to simulate two additional roulette wheels, the results of which are shown on the display 80. In FIG. 1 the electronically generated roulette wheel result displays are shown at 82 and 84. The side wagers are referred to as "Colour Match" and "Number Match" and players make bets on the results (detailed below) by placing chips in the regions 90 and 92, respectively, on the wagering surface 70. The side wagers are an independent wager that the player may place for a chance of winning odds that are in excess of traditional Roulette, based on the results of the normal roulette wheel and the two electronically generated roulette wheels. The side bet results are determined by whether the live wheel and simulated wheel results match in colour or number, but not upon the particular number result itself.

Colour Match

The Colour Match wager depends on the colour result (red, black, green) of the three roulette wheels. Two winning results are possible:

- Matching colour on all three wheels, either all black or all red will win at odds of 3-to-1.
- Matching colour on all three wheels, all green (i.e. any zeros) will win at odds of 500-to-1.

Number Match

The Number Match wager depends on the numerical result of the three roulette wheels. Two winning results are possible:

- A matching number on the live wheel with either one of the electronic wheels will win at odds of 10-to-1.
- A matching number on all three wheels will win at odds of 500-to-1.

In the example illustrated in FIG. 1, the live wheel shows the ball has landed in the pocket corresponding to the number 4 (colour black), whilst the electronically generated wheels show the results of the number 4 (black) and number 3 (red). Therefore, in this case there is no winning Colour match result (two black, one red), but there would be a winning Number Match payout of 10-to-1 based on the number 4 result on the live wheel and one of the simulated wheels.

Figure 2:
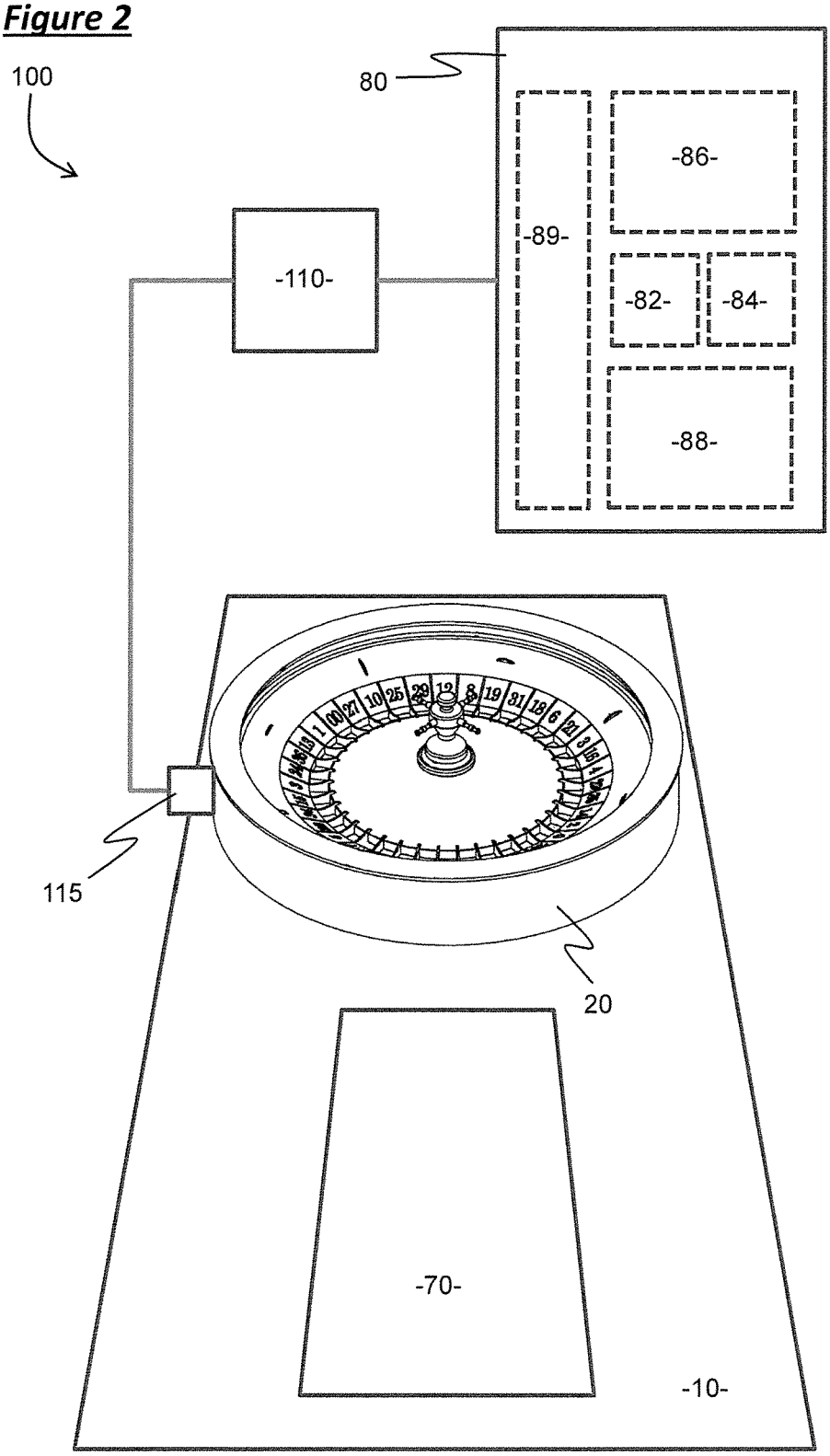
FIG. 2 is a diagrammatic illustration of a system according to an embodiment of the present invention.
Figure 4:
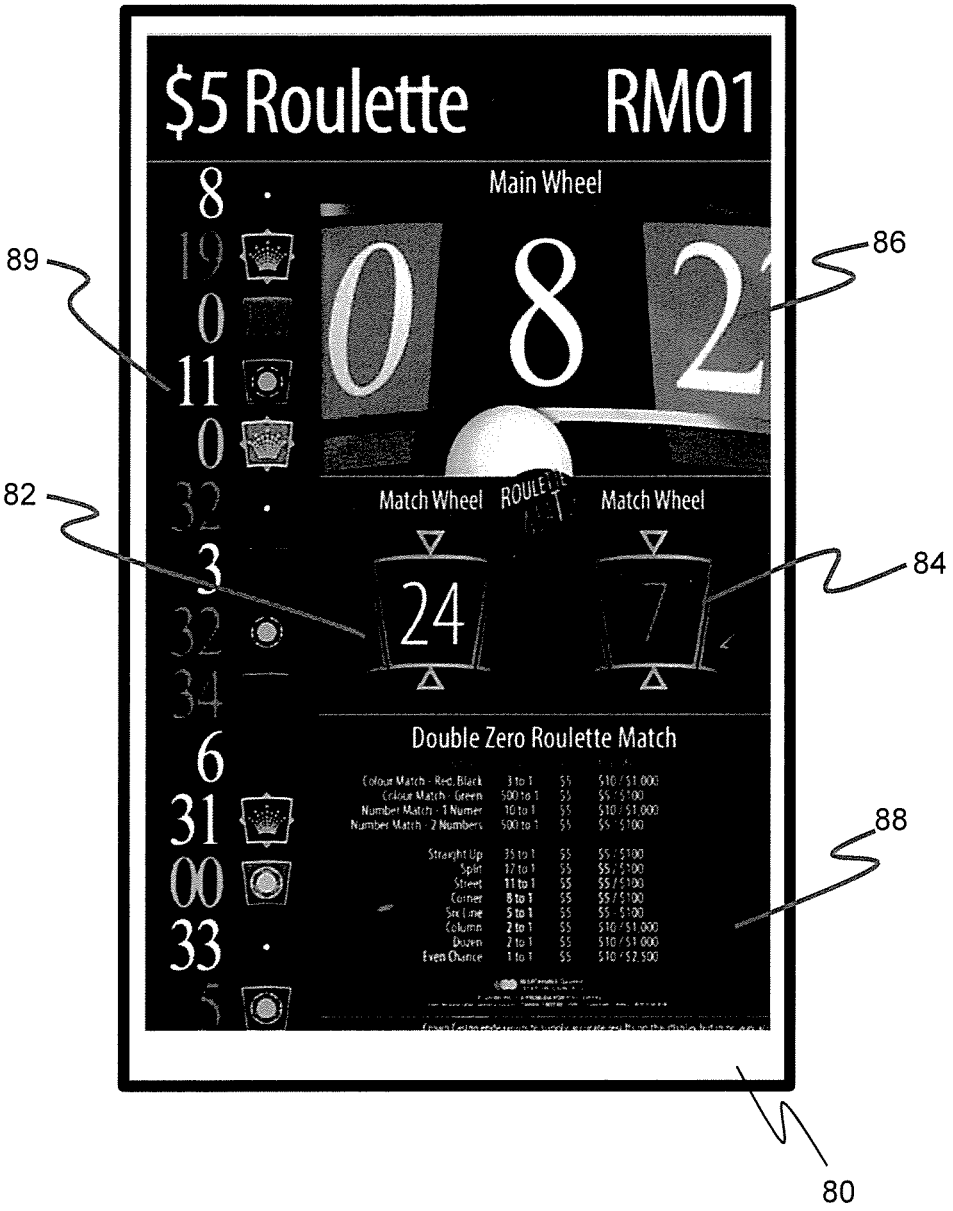
FIG. 4 is an illustration of an example of a computer generated display for use in an embodiment of the invention.

FIG. 2 is a diagrammatic illustration of a system 100 for implementing the game as described above. The roulette table 10 is shown with roulette wheel 20 and wagering surface 70, as described above. The system additionally includes a display screen 80 controlled by a computer apparatus 110. The computer apparatus 110 is adapted to present, by way of the display screen 80, the latest result (86) from the live roulette wheel 20, a list of historical results (89) from the roulette wheel 20, and other information (88) as may be desired to display to players from time to time. The computer apparatus is also programmed to generate two separate random numbers within the range of numbers on the roulette wheel (i.e. 00, 0, 1-36) and display the selected numbers on the screen (82, 84). The display of the random numbers on the screen (82, 84) may include a computer generated roulette wheel simulation animation or the like, if desired, or some other form of animated display for visual appeal. An illustration of an example of a computer controlled display is included herein as FIG. 4.

It is important for the game function that there be some form of synchronisation between the computer generated numbers and the live wheel. The computer apparatus should generate and display two new random number results each and every time the live wheel produces a new result. Furthermore, in the interests of efficient casino operation it is desirable that the computer generated results be produced and displayed within a short period of the live wheel result, so that all bets can be settled promptly in preparation for the next game. Additionally, it may be preferred that the computer generated results be displayed shortly before the live wheel result is determined, so that there can be no perception of the computer generated results being produced in response to the live wheel result. However, the computer generated results should not be displayed before the croupier closes betting, which is typically after the live wheel roulette ball is already in motion.

One way of determining the timing for the computer generated results is based on operator input, from the croupier for example. This may be accomplished through use of a human operated button or switch (not shown in the drawings) coupled to provide a signal to the computer apparatus. For example, the computer apparatus 110 may be programmed to generate and display the two random number (simulated roulette) results within some predetermined time period after activation of the button by the croupier. In performance of a typical table roulette game the croupier spins the wheel (although in some cases the wheel motion may be automated or motorised), and then releases the ball rolling around the fixed rim in the opposite direction. At some time before the ball's motion slows sufficiently for it to descend radially toward the spinning wheel the croupier declares "last bets" following which players are not permitted to make any more bets, or change bets that have already been placed. Shortly after that the ball descends to the wheel and bounces around until eventually coming to rest in one of the numbered pockets on wheel, thus determining the result. The exact amount of time that elapses from the call of last bets until the ball comes to rest varies from one game to the next according to numerous factors and random distribution, however there may be determined a minimum time period. Thus, it may be desirable for the computer generated results to be displayed at some time during that minimum period after the last bets call and before the live wheel result. Accordingly, the gaming system may be arranged for the croupier to activate the button contemporaneously with the call of last bets, signalling to the computer apparatus which is then programmed to produce the simulated results within a time period less than the minimum period determined for a live wheel result.

Alternatively, the timing synchronisation of the computer generated results with the live wheel result may be accomplished by automated means. As mentioned above, various methods and systems are known for automated determination of the live roulette wheel result, for the purpose for example of presentation on the display screen (86). One way in which this can be done is through the use of one or more optical sensors mounted in the rim of the roulette wheel 20. An example of such a system is described, for example, in the specification of U.S. Pat. No. 5,836,583 entitled "Detection system for detecting a position of a ball on a roulette wheel". Whilst the described detection system is primarily for use in determining the ultimate resting position (pocket) of the ball on the spinning wheel, it may also be utilised to determine motion of the ball around the rim of the roulette wheel before it descends. In particular, the sensor (e.g. diagrammatically illustrated at 115 in FIG. 2) may be used to determine the approximate timing of the release of the ball by the croupier and/or timing of the descent of the ball from the rim. A signal from the sensor 115 to the computer apparatus 110 signifying either one of these events may be used to determine the timing for generation of the simulated random number results, in similar manner to that discussed above in response to an operator signal.

The precise timing of the computer generated results may differ depending on the sensor signal utilised, however. Where the signal signifies release of the ball by the croupier a longer delay may be required so that the computer generated results are not displayed before the croupier calls for last bets. Conversely, if the signal utilised signifies descent of the ball from the rim then last bets has already been called and the live wheel result is imminent, thus requiring a relatively immediate computer generated result in order to precede the live wheel result.

Figure 3:
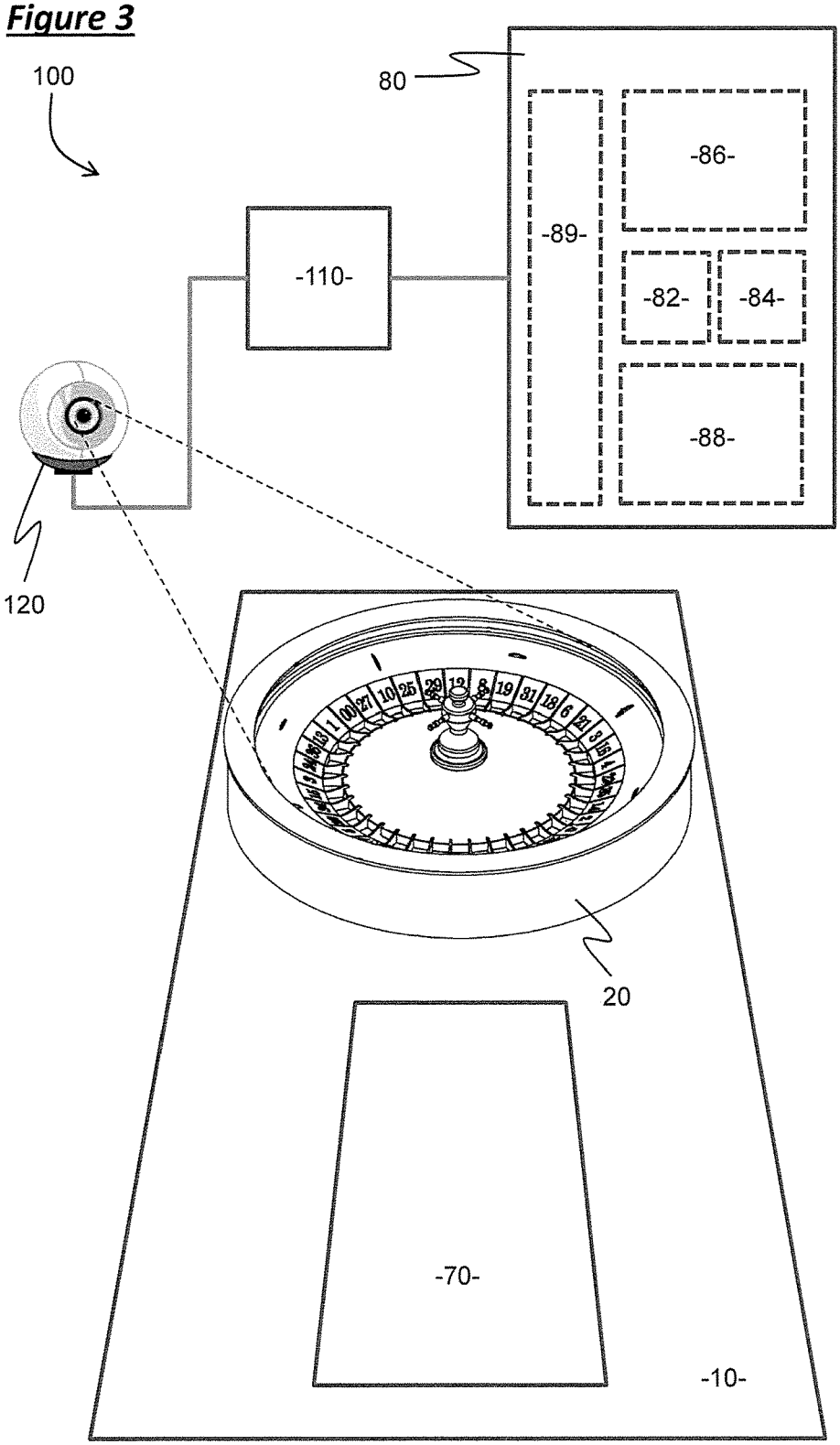
FIG. 3 is a diagrammatic illustration of a system according to another embodiment of the present invention.

Another way in which the timing synchronisation of the computer generated results with the live wheel result may be accomplished by automated means is through use of a sensor that is not incorporated in the roulette wheel itself, but provided separately such as in the form of a digital camera. The system 100 utilising this type of sensor (120) is diagrammatically illustrated in FIG. 3. In this case timing signals signifying the state of the live wheel are derived from analysis of digital images captured by the camera 120, which processing may be performed by the computing apparatus 110. Similar timing signals as discussed above may be obtained, however, enabling the computer generated roulette results to be produced and displayed in the same manner with respect to the timing of the live wheel result. By way of example, U.S. Pat. No. 8,376,827 describes a system by which timing signals can be derived from roulette ball motion during a roulette game through the use of video camera image analysis.

Figure 5:
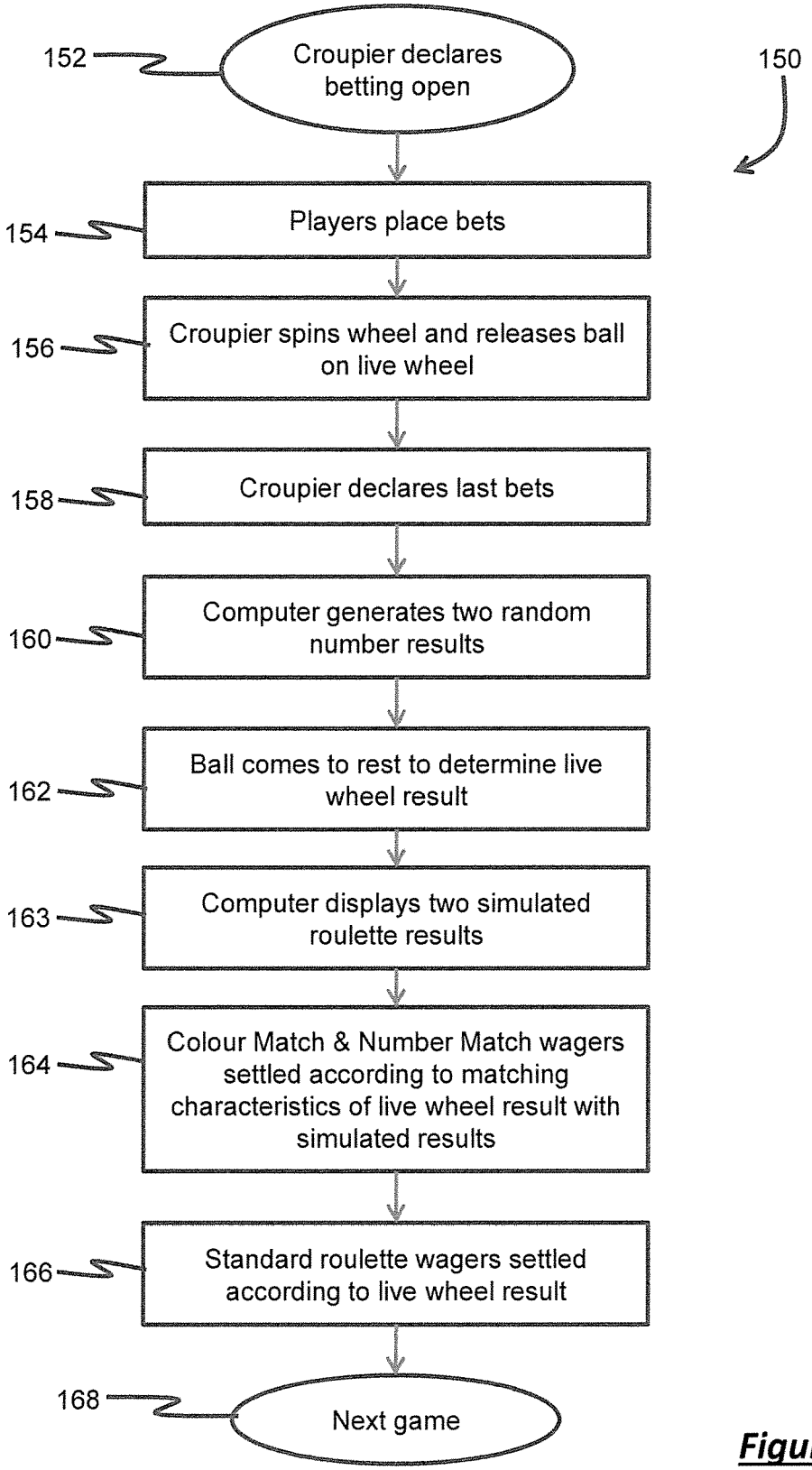
FIG. 5 is a flow chart diagram of a method according to an embodiment of the invention.

FIG. 5 is a flow chart diagram (150) that outlines the method of game play according to an embodiment of the invention. To begin the game the croupier ensures that the betting surface is clear and then declares betting open to players (152). Players are then allowed to place bets on the next result by placing chips or markers on the indicia printed on the betting surface corresponding to the result they wish to wager on. Possible bets include those ordinarily provided for in roulette, in addition to the Colour Match and Number Match side bets. Ordinary roulette bets are based solely on the result produced by the table roulette wheel, whereas the Colour Match and Number Match side bets are determined by both the live wheel and the two computer-generated results. After a certain period of time the croupier spins the wheel and then releases the ball (156) which rolls around the rim of the roulette wheel. Shortly thereafter, before the ball descends from the rim, the croupier declares betting closed (158) following which no more bets are allowed.

Sometime after betting is closed the computer generates two new random number results (160). Then, the ball coming to rest in one of the roulette wheel's numbered pockets (162) determines the roulette table result for that game, which may be sensed or otherwise input for display on the computer controlled screen for player convenience. After the live roulette wheel result has been determined, the simulated roulette results are displayed (163), based on the random numbers previously generated. Wagers placed by players in the Colour Match and Number Match boxes are then settled (164) according to matching characteristics of the live wheel result with the computer generated results, as discussed above. The Colour Match and Number Match results may also be displayed on the computer controlled screen. Finally, standard roulette wagers are then settled by the croupier according to the live wheel result (166). Once all bets have been settled the croupier prepares the table for the next game (168).

A variation of the game as described above utilises a characteristic of the random number generators to implement an additional bonus payout event. In this case, upon occurrence of the bonus event, all players that have placed a wager in either the Colour Match or Number Match boxes will be rewarded with a bonus payout. For example, the side bet events and payout odds may be structured as follows:

- Colour Match wagers are paid at 3-to-1 in the event of all three wheels with matching colour—red or black
- Colour Match wagers are paid at 250-to-1 in the event of all three wheels with matching colour—green
- Number Match wagers are paid at 12-to-1 in the event of the number on the live wheel matching with either one of the simulated wheels
- Number Match wagers are paid at 300-to-1 in the event of the number on the live wheel matching with both of the simulated wheels
- Colour Match and Number Match wagers are paid at 500-to-1 on occurrence of the bonus event The bonus event is determined solely by the random number generators, and may be introduced in order to account for characteristic of the random number generators, as explained below. For the roulette side bet system described herein to operate in a commercial environment (e.g. in a casino), for every spin of the live roulette wheel each of the simulated wheels should produce a result (based on random number generation) that has an equal probability of corresponding to each pocket on the live wheel. However, in practice it may not be possible to evenly allocate the range of the computerised random number generator amongst the number of pockets on the live wheel. In other words, the range of possible integer numbers from the random number generator may not be an integer multiple of the number of pockets on the roulette wheel or, mathematically:

$$a \text{ modulo } n \neq 0$$

where a is the random number generator range; and n is the number of pockets on the roulette wheel.

Consider an example of a random number generator with a range of 10,000 and a roulette wheel with 38 pockets, where 10,000=38×263+6. Thus, in order for there to be an equal probability corresponding to each of the 38 pockets, the range of the random number generator means that there will be a minimum of 6 possible results that cannot be allocated. It is this remainder that is used to signal the bonus event. In this example, with two random number generators (corresponding to the two simulated wheels) the chances are that 12 times out of each 10,000 one or other of the random number generators will produce a result that does not correspond to any roulette wheel pocket.

More generally, for a randomly generated number r.

$$\text{for any } r \leq |a/n| * n \rightarrow s = r \text{ modulo } n$$

$$\text{for any } r > |a/n| * n \rightarrow \text{bonus event}$$

where s is the simulated roulette wheel result.

Using the bonus system as described above it is possible to produce a usable result, either a simulated wheel number or a bonus event, from the random number generator regardless of its particular range. The numbers used in the example above are for the purposes of explanation only, and it is possible that the random number generator may in fact have a much larger range. In such a case, in order to obtain a desired bonus event probability appropriate for the payout odds on offer, a subset of the random number range that is greater than the simple remainder may be selected. For example, consider a random number generator with a range of $2^{22}$=4,194,304 where it is desired that a bonus event probability (for one random number generator) is approximately 1 in 1,000:

$$\begin{aligned} 4{,}194{,}304 &= (38 \times 110{,}376) + 6 \\ &= (38 \times 110{,}266) \text{ (numbers corresponding to wheel pockets)} + \\ &\quad (38 \times 110 + 6) \text{ (numbers corresponding to bonus event)} \end{aligned}$$

In this example, for every activation of the random number generator each of the simulated wheel pockets has an equal probability of selection (110,266 in 4,194,304), and the probability of the bonus event has been chosen to be 4,186 in 4,194,304 (approximately 1 in 1,000).

Whilst the preceding description is based on the use of a casino roulette table attended by a croupier who controls the wheel and ball and utilising physical chips or markers on a table playing surface to signify wagers by players, various levels of computerised automation are also possible to achieve equivalent outcomes. For example, motorised and automated roulette wheels are known that do not require a human operator to spin the wheel and/or release the ball. Moreover, it is also possible for the placement and settling of bets to be computer implemented through the use of computer controlled display devices and user input means, such as a touch-screen display for example. The computer processor arranged for accepting and settling player wagers may be the same computer (110) employed for generating and displaying simulated game results, or the processors may simply be in communication with one another.

Figure 6:
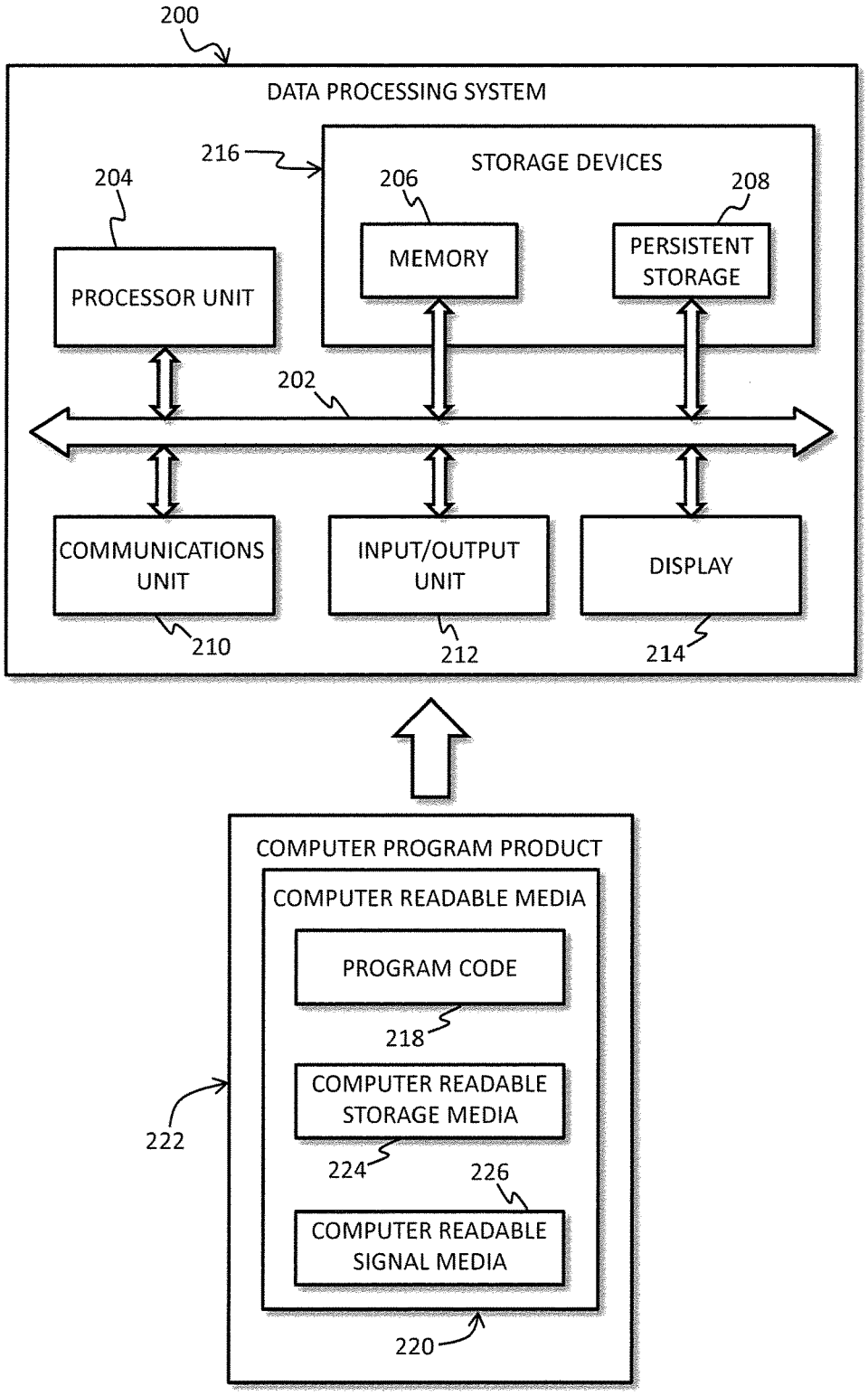
FIG. 6 is a diagrammatic illustration of a system by which a fully automated, computer-based game may be implemented in accordance with another embodiment of the invention.

FIG. 6 is a diagrammatic illustration of a system 200 by which a fully automated, computer-based game may be implemented in accordance with another embodiment of the invention. Data processing system 200 may be used to implement one or more computers adapted to carry out coded instructions in the form of computer software programs, routines and/or applications to perform the functions of the present invention as described above. In this illustrative example, data processing system 200 includes communications framework 202, which provides communications between processor unit 204, memory 206, persistent storage 208, communications unit 210, input/output unit 212, and display 214. In this example, communications framework 202 may take the form of a bus system.

Processor unit 204 serves to execute instructions for software that may be loaded into memory 206. Processor unit 204 may be a number of processors, a multi-processor core, or some other type of processor, depending on the particular implementation.

Memory 206 and persistent storage 208 are examples of storage devices 216. A storage device is any piece of hardware that is capable of storing information, such as, for example, without limitation, data, program code in functional form, and/or other suitable information either on a temporary basis and/or a permanent basis. Storage devices 216 may also be referred to as computer readable storage devices in this illustrative example. Memory 206, in these examples, may be, for example, a random access memory or any other suitable volatile or non-volatile storage device. Persistent storage 208 may take various forms, depending on the particular implementation.

For example, persistent storage 208 may contain one or more components or devices. For example, persistent storage 208 may be a hard drive, a flash memory, a rewritable optical disk, a rewritable magnetic tape, or some combination of the above. The media used by persistent storage 208 also may be removable. For example, a removable hard drive may be used for persistent storage 208.

Communications unit 210, in this illustrative example, provides for communications with other data processing systems or devices. In this illustrative example, communications unit 210 is a network interface circuit providing wired and, most preferably, wireless communications according to known protocols.

Input/output unit 212 allows for input and output of data with other devices that may be connected to data processing system as well as user interaction therewith. For example, input/output unit 212 may provide a connection for user input through a touchscreen interface, a keyboard, a mouse, and/or some other suitable input device. Display 214 provides a mechanism to display information to a user.

Instructions for the operating system, applications, and/or programs may be located in storage devices 216, which are in communication with processor unit 204 through communications framework 202. The processes of the different embodiments may be performed by processor unit 204 using computer-implemented instructions, which may be located in a memory, such as memory 206.

These instructions are referred to as program code, computer usable program code, or computer readable program code that may be read and executed by a processor in processor unit 204. The program code in the different embodiments may be embodied on different physical or computer readable storage media, such as memory 206 or persistent storage 208.

Program code 218 is located in a functional form on computer readable media 220 that is selectively removable and may be loaded onto or transferred to data processing system 200 for execution by processor unit 204. Program code 218 and computer readable media 220 form computer program product 222 in this illustrative example. In one example, computer readable media 220 may be computer readable storage media 224 or computer readable signal media 226.

Alternatively, program code 218 may be transferred to data processing system 200 using computer readable signal media 226. Computer readable signal media 226 may be, for example, a propagated data signal containing program code 218. For example, computer readable signal media 226 may be an electromagnetic signal, an optical signal, and/or any other suitable type of signal. These signals may be transmitted over communications links, such as wireless communications links, optical fibre cable, coaxial cable, a wire, and/or any other suitable type of communications link.

The data processing system 200 may form part of an electronic gaming machine, for example, located in a casino or gaming venue. Equally, the data processing system 200 may be in the form of a home computer, laptop, tablet smartphone or other portable computing device.

The program code 218 that is executed by the processor unit 204 is structured to implement an automated version of the roulette game described hereinabove. Thus, in this case the data processing system 200 performs the functions of the computer apparatus 110 and display screen 80 as described in relation to FIG. 2, for example. Additionally, the program code is structured to simulate the "live" roulette wheel, provide means for one or more users to place wagers on the primary wheel result and the Colour/Number Match results, and to settle the wagers at the conclusion of each game.

In a different alternative, rather than using computer generated random numbers and simulated roulette wheels, it is also possible to implement the game of the present invention using three live roulette wheels. For example, three casino roulette wheels may be arranged to that two of them provide the additional results required for the Colour Match and Number Match results for the other one. The three roulette tables may be in the same physical region, or may in fact be remote from one another. In the interests of efficiency the three roulette tables should preferably be arranged to produce respective results at least roughly in synchronism.

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

The following sections I-VI provide a guide to interpreting the present specification.

I. Terms

The term "product" means any machine, manufacture and/or composition of matter, unless expressly specified otherwise.

The term "process" means any process, algorithm, method or the like, unless expressly specified otherwise.

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

The term "invention" and the like mean "the one or more inventions disclosed in this specification", unless expressly specified otherwise.

The terms "an embodiment", "embodiment", "embodiments", "the embodiment", "the embodiments", "one or more embodiments", "some embodiments", "certain embodiments", "one embodiment", "another embodiment" and the like mean "one or more (but not all) embodiments of the disclosed invention(s)", unless expressly specified otherwise.

The term "variation" of an invention means an embodiment of the invention, unless expressly specified otherwise.

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present specification, including anything which may be incorporated by reference", unless expressly specified otherwise.

The phrase "at least one of", when such phrase modifies a plurality of things (such as an enumerated list of things), means any combination of one or more of those things, unless expressly specified otherwise. For example, the phrase "at least one of a widget, a car and a wheel" means either (i) a widget, (ii) a car, (iii) a wheel, (iv) a widget and a car, (v) a widget and a wheel, (vi) a car and a wheel, or (vii) a widget, a car and a wheel. The phrase "at least one of", when such phrase modifies a plurality of things, does not mean "one of" each of the plurality of things.

Numerical terms such as "one", "two", etc. when used as cardinal numbers to indicate quantity of something (e.g., one widget, two widgets), mean the quantity indicated by that numerical term, but do not mean at least the quantity indicated by that numerical term. For example, the phrase "one widget" does not mean "at least one widget", and therefore the phrase "one widget" does not cover, e.g., two widgets.

The phrase "based on" does not mean "based only on", unless expressly specified otherwise. In other words, the phrase "based on" describes both "based only on" and "based at least on". The phrase "based at least on" is equivalent to the phrase "based at least in part on".

The term "represent" and like terms are not exclusive, unless expressly specified otherwise. For example, the term "represents" does not mean "represents only", unless expressly specified otherwise. In other words, the phrase "the data represents a credit card number" describes both "the data represents only a credit card number" and "the data represents a credit card number and the data also represents something else".

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

The term "e.g." and like terms mean "for example", and thus does not limit the term or phrase it explains. For example, in the sentence "the computer sends data (e.g., instructions, a data structure) over the Internet", the term "e.g." explains that "instructions" are an example of "data" that the computer may send over the Internet, and also explains that "a data structure" is an example of "data" that the computer may send over the Internet. However, both "instructions" and "a data structure" are merely examples of "data", and other things besides "instructions" and "a data structure" can be "data".

The term "i.e." and like terms mean "that is", and thus limits the term or phrase it explains. For example, in the sentence "the computer sends data (i.e., instructions) over the Internet", the term "i.e." explains that "instructions" are the "data" that the computer sends over the Internet.

Any given numerical range shall include whole and fractions of numbers within the range. For example, the range "1 to 10" shall be interpreted to specifically include whole numbers between 1 and 10 (e.g., 2, 3, 4, . . . 9) and non-whole numbers (e.g., 1.1, 1.2, . . . 1.9).

II. Determining

The term "determining" and grammatical variants thereof (e.g., to determine a price, determining a value, determine an object which meets a certain criterion) is used in an extremely broad sense. The term "determining" encompasses a wide variety of actions and therefore "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing, and the like.

The term "determining" does not imply certainty or absolute precision, and therefore "determining" can include estimating, extrapolating, predicting, guessing and the like.

The term "determining" does not imply that mathematical processing must be performed, and does not imply that numerical methods must be used, and does not imply that an algorithm or process is used.

The term "determining" does not imply that any particular device must be used. For example, a computer need not necessarily perform the determining.

III. Indication

The term "indication" is used in an extremely broad sense. The term "indication" may, among other things, encompass a sign, symptom, or token of something else.

The term "indication" may be used to refer to any indicia and/or other information indicative of or associated with a subject, item, entity, and/or other object and/or idea.

As used herein, the phrases "information indicative of" and "indicia" may be used to refer to any information that represents, describes, and/or is otherwise associated with a related entity, subject, or object.

Indicia of information may include, for example, a code, a reference, a link, a signal, an identifier, and/or any combination thereof and/or any other informative representation associated with the information.

In some embodiments, indicia of information (or indicative of the information) may be or include the information itself and/or any portion or component of the information. In some embodiments, an indication may include a request, a solicitation, a broadcast, and/or any other form of information gathering and/or dissemination.

IV. Forms of Sentences

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device/article (whether or not they cooperate) may alternatively be used in place of the single device/article that is described. Accordingly, the functionality that is described as being possessed by a device may alternatively be possessed by more than one device/article (whether or not they cooperate).

Similarly, where more than one device or article is described herein (whether or not they cooperate), a single device/article may alternatively be used in place of the more than one device or article that is described. For example, a plurality of computer-based devices may be substituted with a single computer-based device. Accordingly, the various functionality that is described as being possessed by more than one device or article may alternatively be possessed by a single device/article.

The functionality and/or the features of a single device that is described may be alternatively embodied by one or more other devices which are described but are not explicitly described as having such functionality/features. Thus, other embodiments need not include the described device itself, but rather can include the one or more other devices which would, in those other embodiments, have such functionality/features.

V. Disclosed Examples and Terminology are not Limiting

Neither the Title nor the Abstract in this specification is intended to be taken as limiting in any way as the scope of the disclosed invention(s). The title and headings of sections provided in the specification are for convenience only, and are not to be taken as limiting the disclosure in any way.

Numerous embodiments are described in the present application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is not a literal description of all embodiments of the invention(s). Also, the present disclosure is not a listing of features of the invention(s) which must be present in all embodiments.

Devices that are described as in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for long periods of time (e.g. weeks at a time). In addition, devices that are in communication with each other may communicate directly or indirectly through one or more intermediaries.

A description of an embodiment with several components or features does not imply that all or even any of such components/features are required. On the contrary, a variety of optional components are described to illustrate the wide variety of possible embodiments of the present invention(s). Unless otherwise specified explicitly, no component/feature is essential or required.

Although process steps, algorithms or the like may be described in a particular sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention(s), and does not imply that the illustrated process is preferred.

Although a process may be described as including a plurality of steps, that does not imply that all or any of the steps are preferred, essential or required. Various other embodiments within the scope of the described invention(s) include other processes that omit some or all of the described steps. Unless otherwise specified explicitly, no step is essential or required.

Although a process may be described singly or without reference to other products or methods, in an embodiment the process may interact with other products or methods. For example, such interaction may include linking one business model to another business model. Such interaction may be provided to enhance the flexibility or desirability of the process.

Although a product may be described as including a plurality of components, aspects, qualities, characteristics and/or features, that does not indicate that any or all of the plurality are preferred, essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

An enumerated list of items (which may or may not be numbered) does not imply that any or all of the items are equivalent to each other or readily substituted for each other.

All embodiments are illustrative, and do not imply that the invention or any embodiments were made or performed, as the case may be.

VI. Computing

It will be readily apparent to one of ordinary skill in the art that the various processes described herein may be implemented by, e.g., appropriately programmed general purpose computers, special purpose computers and computing devices. Typically a processor (e.g., one or more microprocessors, one or more microcontrollers, one or more digital signal processors) will receive instructions (e.g., from a memory or like device), and execute those instructions, thereby performing one or more processes defined by those instructions.

A "processor" means one or more microprocessors, central processing units (CPUs), computing devices, microcontrollers, digital signal processors, or like devices or any combination thereof.

Thus a description of a process is likewise a description of an apparatus for performing the process. The apparatus that performs the process can include, e.g., a processor and those input devices and output devices that are appropriate to perform the process.

Further, programs that implement such methods (as well as other types of data) may be stored and transmitted using a variety of media (e.g., computer readable media) in a number of manners. In some embodiments, hard-wired circuitry or custom hardware may be used in place of, or in combination with, some or all of the software instructions that can implement the processes of various embodiments.

Thus, various combinations of hardware and software may be used instead of software only.

The term "computer-readable medium" refers to any medium, a plurality of the same, or a combination of different media, that participate in providing data (e.g., instructions, data structures) which may be read by a computer, a processor or a like device. Such a medium may take many forms, including but not limited to, non-volatile media, volatile media, and transmission media. Non-volatile media include, for example, optical or magnetic disks and other persistent memory. Volatile media include dynamic random access memory (DRAM), which typically constitutes the main memory. Transmission media include coaxial cables, copper wire and fiber optics, including the wires that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying data (e.g. sequences of instructions) to a processor. For example, data may be (i) delivered from RAM to a processor; (ii) carried over a wireless transmission medium; (iii) formatted and/or transmitted according to numerous formats, standards or protocols, such as Ethernet (or IEEE 802.3), SAP, ATP, Bluetooth™, and TCP/IP, TDMA, CDMA, and 3G; and/or (iv) encrypted to ensure privacy or prevent fraud in any of a variety of ways well known in the art.

Thus a description of a process is likewise a description of a computer-readable medium storing a program for performing the process. The computer-readable medium can store (in any appropriate format) those program elements which are appropriate to perform the method.

Just as the description of various steps in a process does not indicate that all the described steps are required, embodiments of an apparatus include a computer/computing device operable to perform some (but not necessarily all) of the described process.

Likewise, just as the description of various steps in a process does not indicate that all the described steps are required, embodiments of a computer-readable medium storing a program or data structure include a computer-readable medium storing a program that, when executed, can cause a processor to perform some (but not necessarily all) of the described process.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models and/or distributed databases) could be used to store and manipulate the data types described herein. Likewise, object methods or behaviours of a database can be used to implement various processes, such as the described herein. In addition, the databases may, in a known manner, be stored locally or remotely from a device which accesses data in such a database.

Various embodiments can be configured to work in a network environment including a computer that is in communication (e.g., via a communications network) with one or more devices. The computer may communicate with the devices directly or indirectly, via any wired or wireless medium (e.g. the Internet, LAN, WAN or Ethernet, Token Ring, a telephone line, a cable line, a radio channel, an optical communications line, commercial on-line service providers, bulletin board systems, a satellite communications link, a combination of any of the above). Each of the devices may themselves comprise computers or other computing devices that are adapted to communicate with the computer. Any number and type of devices may be in communication with the computer.

In an embodiment, a server computer or centralized authority may not be necessary or desirable. For example, the present invention may, in an embodiment, be practiced on one or more devices without a central authority. In such an embodiment, any functions described herein as performed by the server computer or data described as stored on the server computer may instead be performed by or stored on one or more such devices.

Where a process is described, in an embodiment the process may operate without any user intervention. In another embodiment, the process includes some human intervention (e.g., a step is performed by or with the assistance of a human).

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. The described embodiments are to be considered in all respects as illustrative only and not restrictive.

Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

It should be noted that where the terms "server", "secure server" or similar terms are used herein, a communication device is described that may be used in a communication system, unless the context otherwise requires, and should not be construed to limit the present invention to any particular communication device type. Thus, a communication device may include, without limitation, a bridge, router, bridge-router (router), switch, node, or other communication device, which may or may not be secure.

It should also be noted that where a flowchart is used herein to demonstrate various aspects of the invention, it should not be construed to limit the present invention to any particular logic flow or logic implementation. The described logic may be partitioned into different logic blocks (e.g., programs, modules, functions, or subroutines) without changing the overall results or otherwise departing from the true scope of the invention. Often, logic elements may be added, modified, omitted, performed in a different order, or implemented using different logic constructs (e.g., logic gates, looping primitives, conditional logic, and other logic constructs) without changing the overall results or otherwise departing from the true scope of the invention.

Various embodiments of the invention may be embodied in many different forms, including computer program logic for use with a processor (e.g., a microprocessor, microcontroller, digital signal processor, or general purpose computer and for that matter, any commercial processor may be used to implement the embodiments of the invention either as a single processor, serial or parallel set of processors in the system and, as such, examples of commercial processors include, but are not limited to Merced™, Pentium™, Pentium II™, Xeon™, Celeron™, Pentium Pro™, Efficeon™, Athlon™, AMD™ and the like), programmable logic for use with a programmable logic device (e.g., a Field Programmable Gate Array (FPGA) or other PLD), discrete components, integrated circuitry (e.g., an Application Specific Integrated Circuit (ASIC)), or any other means including any combination thereof. In an exemplary embodiment of the present invention, predominantly all of the communication between users and the server is implemented as a set of computer program instructions that is converted into a computer executable form, stored as such in a computer readable medium, and executed by a microprocessor under the control of an operating system.

Computer program logic implementing all or part of the functionality where described herein may be embodied in various forms, including a source code form, a computer executable form, and various intermediate forms (e.g., forms generated by an assembler, compiler, linker, or locator). Source code may include a series of computer program instructions implemented in any of various programming languages (e.g., an object code, an assembly language, or a high-level language such as Fortran, C, C++, JAVA, or HTML. Moreover, there are hundreds of available computer languages that may be used to implement embodiments of the invention, among the more common being Ada; Algol; APL; awk; Basic; C; C++; Conol; Delphi; Eiffel; Euphoria; Forth; Fortran; HTML; Icon; Java; Javascript; Lisp; Logo; Mathematica; MatLab; Miranda; Modula-2; Oberon; Pascal; Perl; PL/I; Prolog; Python; Rexx; SAS; Scheme; sed; Simula; Smalltalk; Snobol; SQL; Visual Basic; Visual C++; Linux and XML.) for use with various operating systems or operating environments. The source code may define and use various data structures and communication messages. The source code may be in a computer executable form (e.g., via an interpreter), or the source code may be converted (e.g., via a translator, assembler, or compiler) into a computer executable form.

The computer program may be fixed in any form (e.g., source code form, computer executable form, or an intermediate form) either permanently or transitorily in a tangible storage medium, such as a semiconductor memory device (e.g, a RAM, ROM, PROM, EEPROM, or Flash-Programmable RAM), a magnetic memory device (e.g., a diskette or fixed disk), an optical memory device (e.g., a CD-ROM or DVD-ROM), a PC card (e.g., PCMCIA card), or other memory device. The computer program may be fixed in any form in a signal that is transmittable to a computer using any of various communication technologies, including, but in no way limited to, analog technologies, digital technologies, optical technologies, wireless technologies (e.g., Bluetooth), networking technologies, and inter-networking technologies. The computer program may be distributed in any form as a removable storage medium with accompanying printed or electronic documentation (e.g., shrink wrapped software), preloaded with a computer system (e.g., on system ROM or fixed disk), or distributed from a server or electronic bulletin board over the communication system (e.g., the Internet or World Wide Web).

Hardware logic (including programmable logic for use with a programmable logic device) implementing all or part of the functionality where described herein may be designed using traditional manual methods, or may be designed, captured, simulated, or documented electronically using various tools, such as Computer Aided Design (CAD), a hardware description language (e.g., VHDL or AHDL), or a PLD programming language (e.g., PALASM, ABEL, or CUPL). Hardware logic may also be incorporated into display screens for implementing embodiments of the invention and which may be segmented display screens, analogue display screens, digital display screens, CRTs, LED screens, Plasma screens, liquid crystal diode screen, and the like.

Programmable logic may be fixed either permanently or transitorily in a tangible storage medium, such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM or DVD-ROM), or other memory device. The programmable logic may be fixed in a signal that is transmittable to a computer using any of various communication technologies, including, but in no way limited to, analog technologies, digital technologies, optical technologies, wireless technologies (e.g., Bluetooth), networking technologies, and internetworking technologies. The programmable logic may be distributed as a removable storage medium with accompanying printed or electronic documentation (e.g., shrink wrapped software), preloaded with a computer system (e.g., on system ROM or fixed disk), or distributed from a server or electronic bulletin board over the communication system (e.g., the Internet or World Wide Web).

The invention claimed is:

1. A method of operating a casino roulette game, including:

providing a roulette wheel having a series of numbers, each number additionally having an assigned colour characteristic;

providing a betting layout having marked areas whereby one or more players may place a bet on a result of the roulette wheel, the betting layout further including first and second side bet areas for placing first and second side bets;

determining the timing of a first event selected from one or a combination of:

release of a ball in the roulette wheel; and a ball in the roulette wheel descending from a rim of the roulette wheel;

determining the timing of a second event in which the roulette wheel produces the game result;

spinning the roulette wheel to produce a game result comprising one of the roulette wheel numbers and its assigned colour characteristic;

providing a random number generator producing, for each spin of the roulette wheel, first and second random numbers selected from the same series of numbers with assigned colour characteristics as represented on the roulette wheel;

wherein the production of the first and second random numbers is performed after determining that the first event has occurred and prior to determining that the second event has occurred;

displaying said first and second random numbers;

settling roulette bets on the basis of the roulette wheel game result;

settling the first side bets on the basis of the roulette wheel game result numerically matching one or both of the first and second random numbers; and settling the second side bets on the basis of the roulette wheel game result colour characteristic matching both of the first and second random number colour characteristics.

2. A method of operating a casino roulette game, including:

providing a roulette wheel having a series of numbers, each number additionally having an assigned colour characteristic;

providing a betting layout having marked areas whereby one or more players may place a bet on a result of the roulette wheel, the betting layout further including at least one side bet area for placing at least one side bet;

determining the timing of a first event selected from one or a combination of:

release of a ball in the roulette wheel; and a ball in the roulette wheel descending from a rim of the roulette wheel;

determining the timing of a second event in which the roulette wheel produces the game result;

spinning the roulette wheel to produce a game result comprising one of the roulette wheel numbers and its assigned colour characteristic; providing a random number generator producing, for each spin of the roulette wheel, at least one random number selected from the same series of numbers with assigned colour characteristics as represented on the roulette wheel;

wherein the production of the at least one random number is performed after determining that the first event has occurred and prior to determining that the second event has occurred;

displaying said at least one random number;

settling roulette bets on the basis of the roulette wheel game result;

settling the at least one side bet on the basis of the roulette wheel game result matching the at least one random number with one or a combination of colour characteristic and number.

3. A method as claimed in claim 2 wherein the random number generator comprises one or more additional roulette wheels.

4. A method as claimed in claim 2 wherein the game is wholly or partly presented in electronic form.

5. A roulette game apparatus, comprising:

a roulette wheel having a series of numbers, each number additionally having an assigned colour characteristic;

a betting layout having marked areas whereby one or more players may place a bet on a result of the roulette wheel, the betting layout further including at least one side bet area for placing at least one side bet;

the roulette wheel adapted for spinning to produce a game result comprising one of the roulette wheel numbers and its assigned colour characteristic;

synchronisation means for determining the timing of a first event selected from one or a combination of:

release of a ball in the roulette wheel; and a ball in the roulette wheel descending from a rim of the roulette wheel; and determining the timing of a second event in which the roulette wheel produces the game result;

a random number generator producing, for each spin of the roulette wheel, at least one random number selected from the same series of numbers with assigned colour characteristics as represented on the roulette wheel;

wherein the random number generator is configured to produce the at least one random number after the synchronisation means has determined that the first event has occurred and prior to the synchronisation means determining that the second event has occurred;

display means for displaying said at least one random number; and processing means for settling roulette bets on the basis of the roulette wheel game result; and settling the at least one side bet on the basis of the roulette wheel game result matching the at least one random number with one or a combination of colour characteristic and number.

6. A roulette game system comprising the roulette game apparatus as claimed in claim 5 wherein the random number generator comprises one or more additional roulette wheels.

7. A roulette game system as claimed in claim 6 wherein the game is wholly or partly presented in electronic form.

8. Apparatus adapted to provide a casino roulette game, said apparatus including: processor means adapted to operate in accordance with a predetermined instruction set, said apparatus, in conjunction with said instruction set, being adapted to perform the method as claimed in claim 2.

* * * * *